US006452591B1

(12) United States Patent
Ho et al.

(10) Patent No.: US 6,452,591 B1
(45) Date of Patent: Sep. 17, 2002

(54) METHOD AND APPARATUS FOR A DATA TRANSMITTER

(75) Inventors: Chak Cheung Edward Ho, Markham; Hugh Chow, Richmond Hill, both of (CA)

(73) Assignee: ATI International SRL, Barbados (KN)

( * ) Notice: Subject to any disclaimer, the term of this patent is extended or adjusted under 35 U.S.C. 154(b) by 0 days.

(21) Appl. No.: 09/370,800

(22) Filed: Aug. 9, 1999

(51) Int. Cl.[7] ..... G09G 5/00

(52) U.S. Cl. ..... 345/213; 345/190; 345/605; 326/38

(58) Field of Search ..... 345/605, 190, 345/213; 326/38

(56) References Cited

U.S. PATENT DOCUMENTS 4,721,943 A 1/1988 Stallkamp
4,745,485 A * 5/1988 Iwasaki ..... 358/236
5,319,395 A * 6/1994 Larky et al. ..... 345/190
5,714,904 A * 2/1998 Jeong ..... 327/407
6,222,380 B1 * 4/2001 Gerowitz et al. ..... 326/38

* cited by examiner

*Primary Examiner*—Richard Hjerpe
*Assistant Examiner*—Jennifer Thuy Nguyen
(74) *Attorney, Agent, or Firm*—Vedder, Price, Kaufman & Kammholz

(57) ABSTRACT

In one embodiment of the present invention, a 10-bit encoded video word is received and stored as two five-bit representations. One of the stored five-bit representations is selected by a multiplexor and provided to a parallel-to-serial converter. The parallel-to-serial converter receives control signals from a multiphase clock. Specifically, the multiphase clock provides a five-phase multi-phased clocks in order to control the parallel-to-serial converter. The serial-to-parallel converter provides a 10-bit serial representation of the 10-bit encoded input.

12 Claims, 6 Drawing Sheets

--PRIOR ART--

--PRIOR ART--

--PRIOR ART--

--PRIOR ART--

METHOD AND APPARATUS FOR A DATA TRANSMITTER

RELATED APPLICATIONS

A related application has been filed entitled "Low Common Mode Impedance Differential Driver And Applications Thereof", having an application Ser. No. 09/287,807 and a filing date of Apr. 7, 1999.

FIELD OF THE INVENTION

The present invention relates generally to the driving of video signals, and more specifically to a method and apparatus for providing digital video signals.

BACKGROUND OF THE INVENTION

Prior to the advent of the laptop computers, display devices most commonly associated with computer systems were cathode ray tube (CRT) display devices. Such CRT systems projected images upon the screen of the display device based upon an analog input. Therefore, graphics adapters provided analog representations of images to the display devices. For example, analog RGB signals (red, green, blue) signals where provided to the display device in order to produce a desired image.

With the advent of laptop computers that used liquid crystal displays (LCDs), it was necessary to convert the analog video into a digital signal in order to accommodate the LCD drivers. As illustrated in FIG. 1, this was accomplished by having the video graphics adapter, or graphics device, produce the analog video signal it always had, and subsequently, a digital-to-analog converter within the display device converted the analog signal to a digital signal in order to provide the proper digital signal to the LCD display drivers. The use of an analog-to-digital converter in the laptop allowed for existing video driver technologies to be compatible with the newly emerging digital flat panel (DFP) display technology.

While the use of an analog-to-digital converter resulted in a readily available market of components capable of supporting DFP display devices, the need for compatibility resulted in additional costs. Specifically, a digital video signal generated by the VGA was converted to an analog signal (i.e. an RGB signal), transmitted, and converted from analog back into digital in order to be used by the digital flat panel display drivers. This resulted in the two conversions, one from digital-to-analog, and second from analog back to digital.

Prior art FIG. 2 illustrates another prior art implementation for transmitting video signals to the DFP display. Specifically, the VGA has been adapted to remove the digital-to-analog conversion step described with reference to FIG. 1. As described above, the digital flat panel display drivers receive digital data, therefore, there was no need for the dual conversions from digital-to-analog and analog-to-digital.

The prior art implementation of FIG. 2 did not convert the original digital data to an analog representation. Instead, the VGA of FIG. 2 merely provided a digital video signal to the display device. The digital video connections of FIG. 2 were accomplished using cables having a plurality of connection. In order to accommodate an RGB signal, the digital video cables used had up to 28 nodes. The 28 nodes were used in order to transmit the three 8-bit signals comprising the RGB colors and four control-bits. However, not only did this implementation require a very wide interface, the high refresh rate required more complex drivers in order to accommodate the full voltage swing necessary to provide the appropriate digital signals to the digital flat panel display. As a result, electromagnetic interference (EMI) concerns resulted. In addition to the wide interface, and EMI concerns, the result in wide interface cable resulted in the increase prices, and required a switching rate necessary to accommodate the DFP.

In order to address problems associated with the use of the wide interface, a serial transmission scheme was introduced. FIG. 3 illustrates one such scheme.

In FIG. 3, the video graphics adapter utilized an encoder for each of the digital signals. The encoder receives the digital data, and converts it to a serial data stream at an increased rate in order to provide each of the digital components to a decoder associated with the digital flat panel display. Generally, each byte of digital data is encoded on the VGA side into a 10-bit representation to be decoded on the DFP side. FIG. 4 illustrates a specific prior art implementation of the VGA encoder of FIG. 3. The VGA encoder receives a 10-bit encoded representation of one of the color signals. In the prior art implementation illustrated, two such 10-bit coded data are latcshed to form a 20-bit wide data word This 20-bit data word is divided into five four-bit segments, which are provided to a five-to-one four-bit multiplexor. The four-bit output of the multiplexor is received by a parallel-to-serial converter. The parallel-to-serial converter converts the received parallel data into a serial stream at a rate approximately 10 times the input reception rate of the 10-bit coded data. In order to accommodate the conversion, a phase locked-loop providing a four-stage multiphase clock is utilized. By controlling the selection of the data provided from the multiplexor to the parallel-to-senal converter it is possible for the prior art device of FIG. 4 to produce the desired transmission rate.

The prior art implementation illustrated in FIG. 4 utilizes a multiphase clock having four phases. One disadvantage with the implementation of FIG. 4 is that multiphase clocks having even number of phases are more costly in terms of design resources, and required silicon space than multiphase clocks having odd numbers of phases. Generally speaking, this is because it is not possible to use basic inverters for even-phased multiphase clocks. As a result, more costly designs must be used.

Therefore, a method and apparatus capable of overcoming the problems associated with prior art video drivers would be desirable.

DETAILED DESCRIPTION OF THE DRAWINGS

In one embodiment of the present invention, a 10-bit encoded video word is received and stored as two five-bit representations. One of the stored five-bit representations is selected by a multiplexor and provided to a parallel-to-serial converter. The parallel-to-serial converter receives control signals from a multiphase clock. Specifically, the multiphase clock provides a five-phase multi-phased clocks in order to control the parallel-to-serial converter. The serial-to-parallel converter provides a 10-bit serial representation of the 10-bit encoded input.

Figure 1:
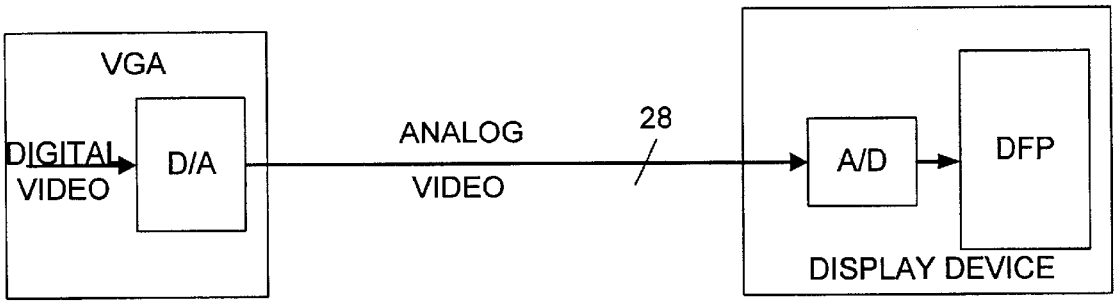
FIGS. 1–4 illustrate prior art implementations of a video driver.
Figure 2:
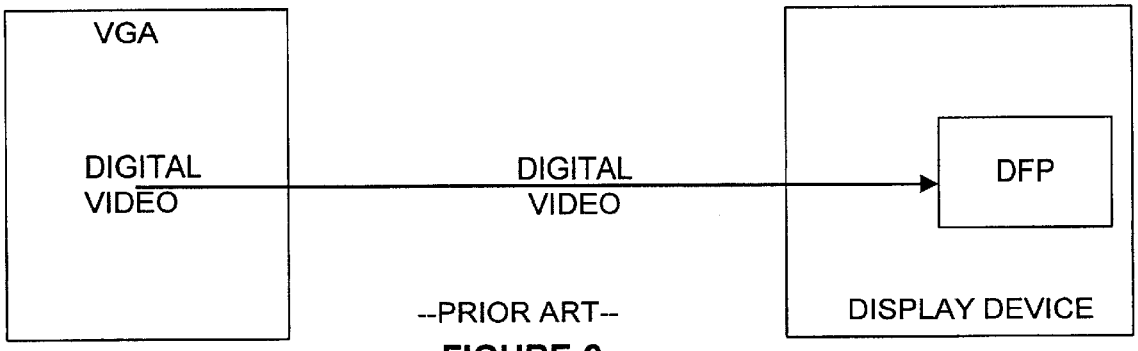
Figure 3:
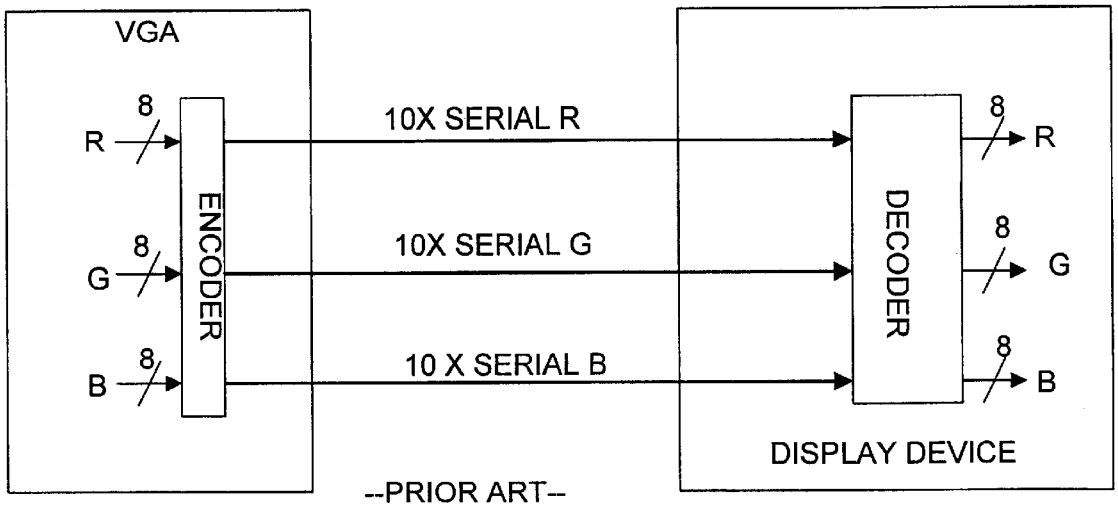
Figure 4:
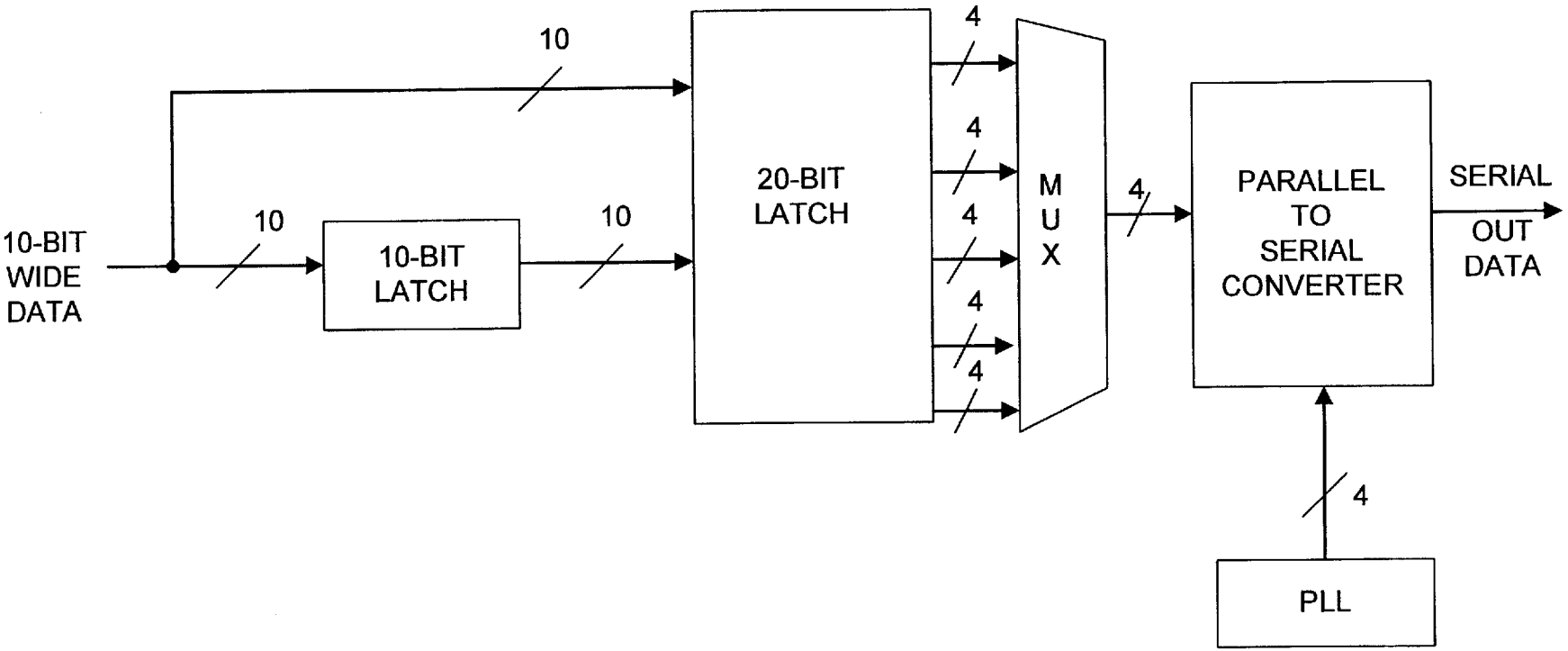
Figure 5:
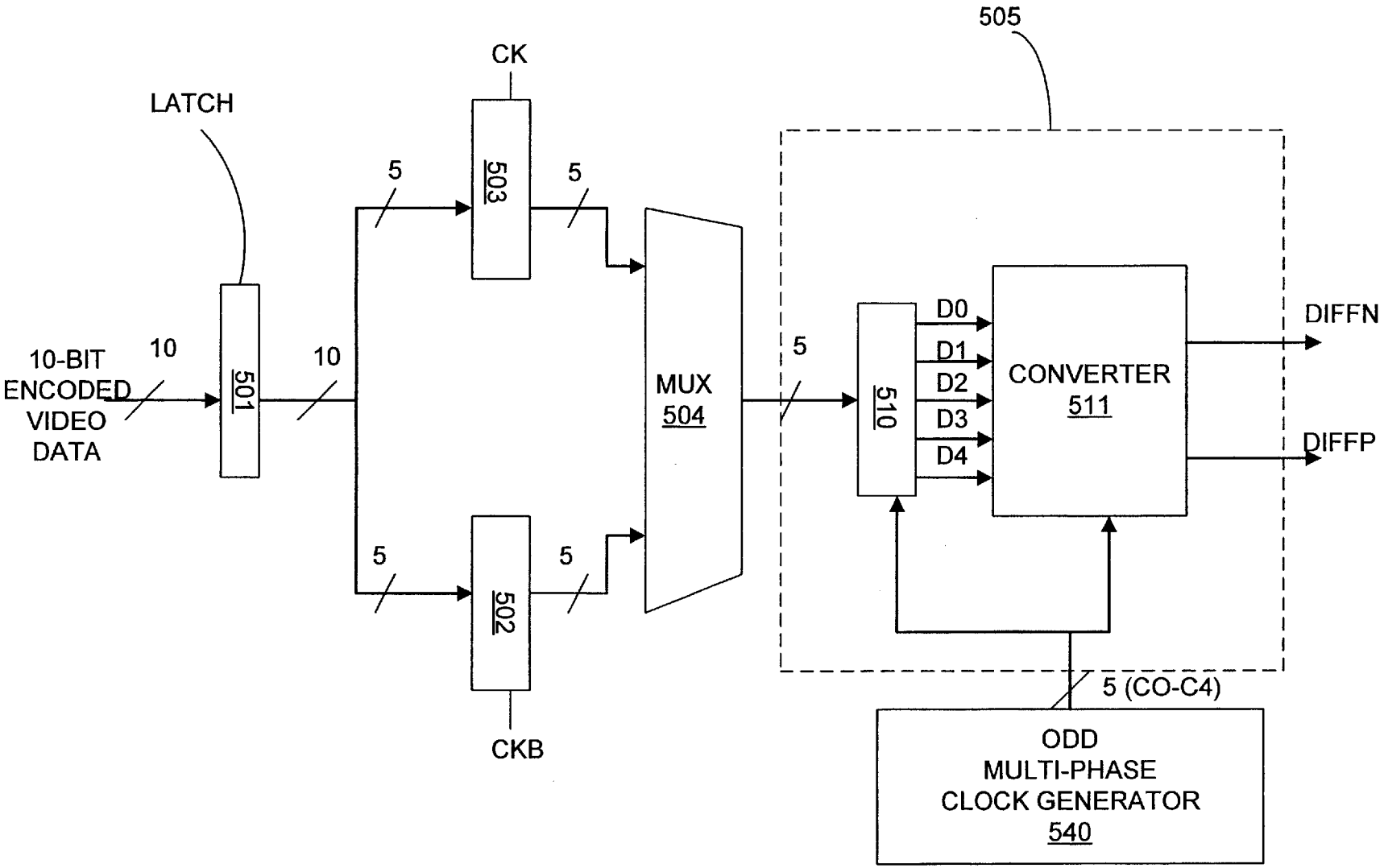
FIG. 5 illustrates, in block form, a specific implementation of a video driver in accordance with the present invention.

The present invention can be best understood with reference to the specific embodiment illustrated in FIG. 5. FIG. 5 illustrates a latch 501 receiving a 10-bit encoded video data signal. Five-bits of the 10-bit signal are received by a latch 503, while the other five-bits are received by a latch 502. The latches 502 and 503 are clocked out of phase with one another in order to assure the next 10-bit encoded video data signal can be received, while one of the two five-bit representations of the previous 10-bit video signal is being processed by other portions of the circuit.

The two five-bit representations at the outputs of latches 502 and 503 are received at inputs of the two-to-one five-bit multiplexor 504. The output of the multiplexor 504 is selected by the clock signal related to the clock which controls latches 502 and 503. By selecting the output of the multiplexor 504 using a related clock, it can be assured that each five-bit representation of latches 502 and 503 will be presented at the output of the multiplexor for approximately one-half of a clock cycle. In effect, the data has been converted from a 10-bit parallel data stream, to a data stream comprising two 5-bit parallel data stream in series. Each five-bit data stream is received by the parallel-to-serial converter 505 in order to be converted from a five-bit parallel stream into a single-bit serial output.

The parallel-to-serial converter 505 includes latch 510, and a converter 511. The latch 510, and converter 511 receive the five-bit data and are controlled by multiphase clock signals generated by the multi-phase clock generator.

Figure 6:
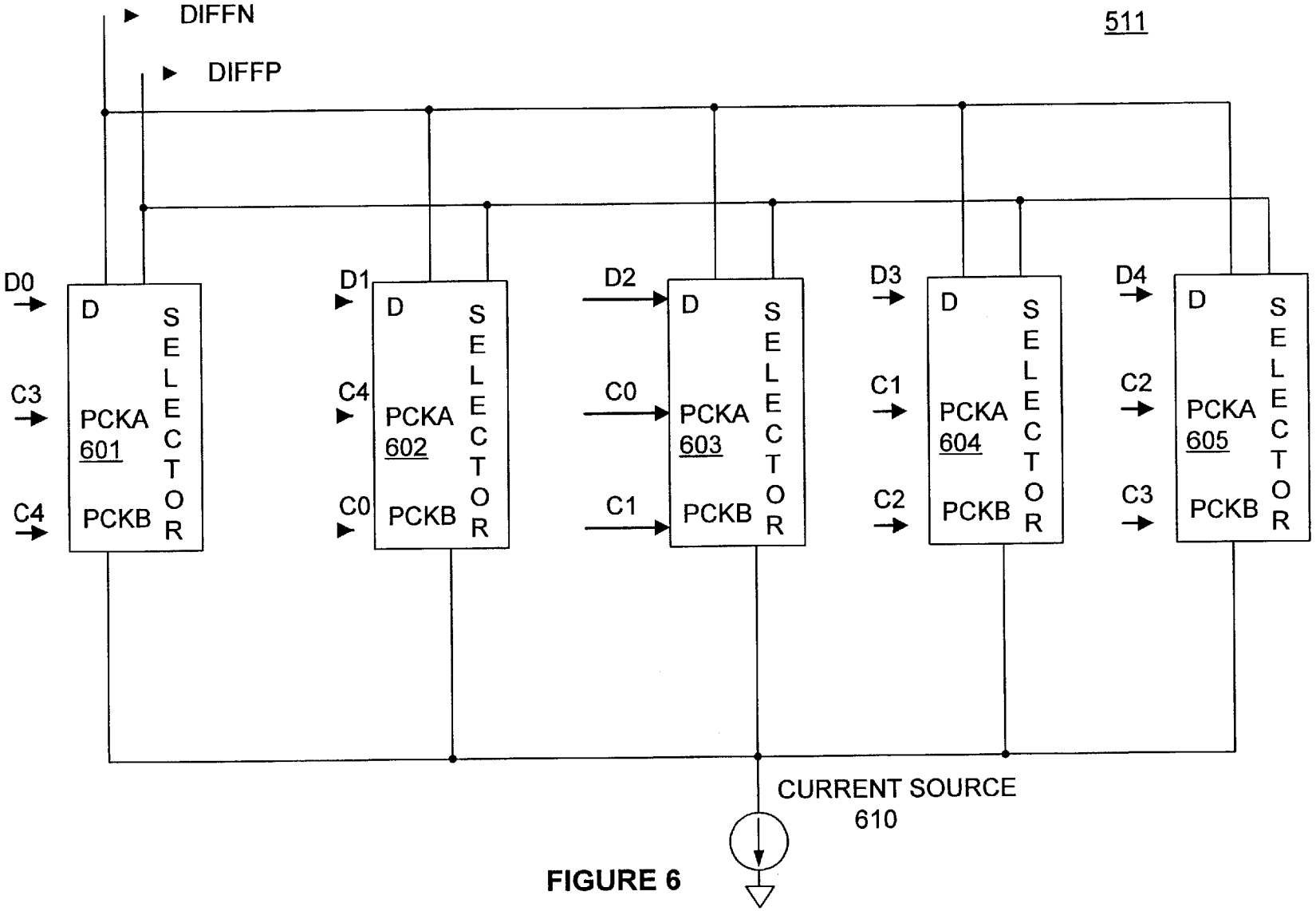
FIG. 6 illustrates, in block diagram form, a portion of the video driver of FIG. 5 in greater detail.

FIG. 6 illustrates in block diagram form individual selector circuits 601 through 605 for providing serial outputs to the differential nodes. Individual selector element 601 provides the data D0 to the differential nodes DIFFN and DIFFP during a first phase defined by the multi-phased clock. This first of the multi-phased clock is defined by multi-phase clocks signal C3 and C4. Likewise, the individual element 602 provides the data D1 during a second phase defined by multi-phase clock signals C4 and C0. Individual element 603 provides the data D2 with respect to multi-phase clock signals C0 and C1. Individual element 604 provides data D3 with respect to multi-phase clock signals C1 and C2. Individual element 605 provides data D4 with respect to multi-phase clock signals C2 and C3.

Figure 7:
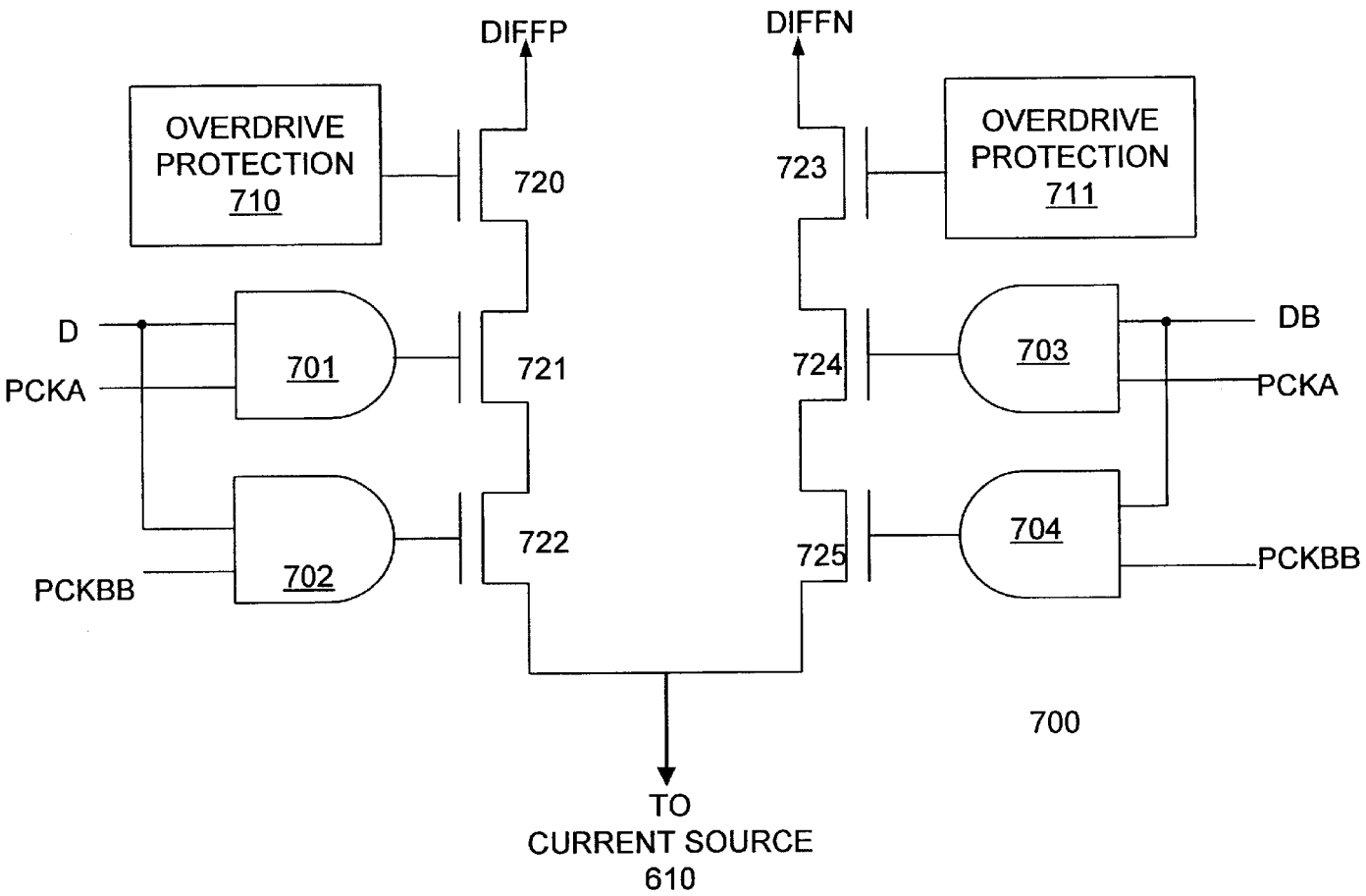
FIG. 7 illustrates, in block and schematic form, a portion of the block diagram of FIG. 6.

FIG. 7 illustrates a specific implementation for the individual select elements 601–605 of FIG. 6. The drain of N-type transistor 720 is connected to the differential node labeled DIFFP. The source of N-type transistor 720 is connected to the drain of N-type transistor 721. The source of N-type transistor 721 is connected to the drain of N-type transistor 722. The source of anti transistor 722 is connected to the current source 610 illustrated in FIG. 6. Likewise, the differential node DIFFN is connected to the drain of N-type transistor 723. The source of N-type transistor 723 is connected to the drain of N-type transistor 724. The source of N-type transistor 724 is connected to the drain of N-type transistor 725. The source of N-type transistor 725 is connected to the source of N-type transistor 722.

In the specific embodiment illustrated, the data signal labeled D is received by a AND gate 701. The inverted data signal labeled DB is received by AND gate 703. The data signals D and DB are gated by the multi-phase clock signal labeled PCKA. The signal PCKBB represents the inverted signal received at node PCKB of FIG. 6. Generally, this inversion is accomplished through the use of an inverter (not shown). As a result, when the signal received at the node PCKA of FIG. 6 is asserted, and the signal received at node PCKB of FIG. 6 is de-asserted, both of the AND gates 701 and 702 will be enabled to allow whatever data value is present on the node D to be provided to the gates of transistors 721 and 722. (The PCKA and PCKB in this paragraph and FIG. 7 are referred to as PCK0 and PCK1 in FIG.6.) Therefore, for selector 602, if node D receives an asserted signal D1, the gates of the transistors 721 and 722 will be asserted when multiphase clock signal C3 is asserted, and multiphase clock signal C4 is de-asserted. Conversely, the AND gates 703 and 704, which receive the same clock signals as gates 701 and 702, receive the inverted data signal DB. Therefore, for the example of selector 602, the gates of transistors 724 and 725 will be de-asserted and be turned off. As a result, the current source 610, which can sink or source current, will sink or source current from the node labeled DIFFP, while no current would be sinked or sourced from the node labeled DN. In this manner, it is possible to provide differential signals capable of being detected by external circuitry.

In order to allow for proper operation in both 3.3 and 2.5 volt systems, overdrive protection circuits 710 and 711 are provided. Specifically, 2.5 volts is provided to the gates of transistors 720 and 723, in order to assure a larger voltage, such as 3.3 volts, external to the circuit will not damage the internal components of the circuit 700.

By implementing the circuit 700 in each of the blocks of FIG. 6, 601–605, it is possible to perform a parallel-to-serial conversion for the 5 data-bits received. By subsequently loading the next five-bits from the multiplexor 504 of FIG. 5, it is possible to perform a 10 to 1 parallel-to-serial conversion at an appropriate data rate. In that the implementation presented, allows for low voltage support, EMI effects are reduced, while maintaining the data rate necessary. A further advantage of the present invention, is that only 3 lines are needed in order to support the digital transmission of video to a digital flat panel display. Furthermore, the present implementation allows for the use of a multiphase clock having an odd number of phases. This allows for the use of more cost effective implementations of phase locked loops as compared to even numbered of multiphase clocks as used in the prior art.

Therefore, it should be apparent to one of ordinary skill in the art, that the present invention provides for advantages over the prior art. One of ordinary skill in the art will further recognize that other implementations in accordance with the present invention can be implemented. For example, the overdrive protection circuits 710 and 711 of FIG. 7, need not necessarily be repeated in each of the blocks 601 through 605 of FIG. 6. For example, a single overdrive protection circuit may be implemented in the FIG. 6 implementation.

Figure 8:
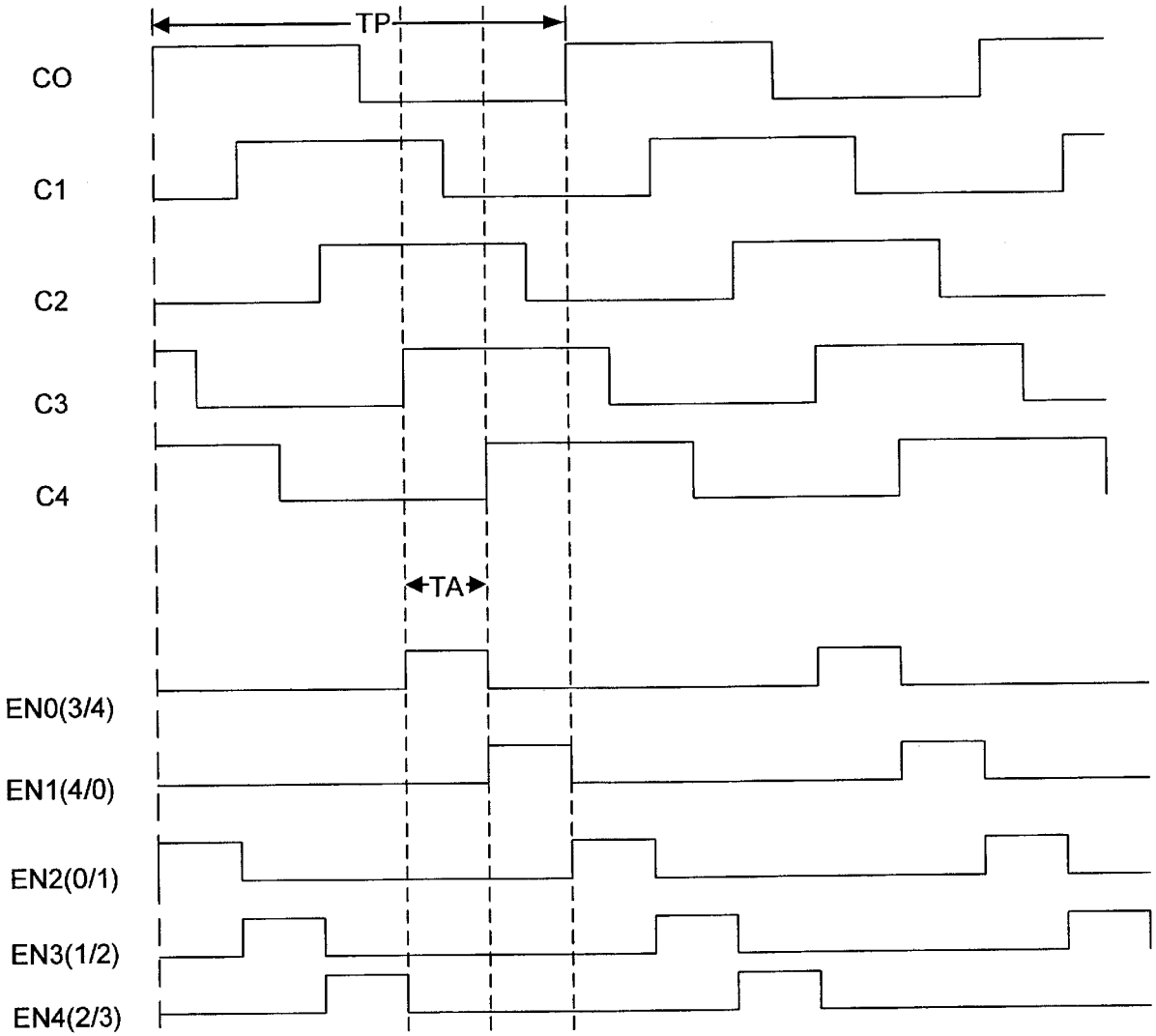
FIG. 8 illustrates a timing diagram of the multi-phase clock signals and the specific times during which data is provided.

FIG. 8 illustrates a timing relationship of the outputs of the multiphase clock 540 of FIG. 5 to time periods that the selectors 601 through 605 are enabled. The time period TP illustrated in FIG. 8 represents the duration of one clock cycle, which is chosen to be approximately ½ time period of a pixel clock cycle. The duration of each clock of the multiphase clock has substantially the same duration TP. However, each individual clock C0 through C4 of the multiphase clocks are phase shifted from one another. For example, the clock C1 is shifted by one-fifth of the clock cycle (72 degrees) from the clock C0. Likewise, each of the clocks C2, C3, and C4, as illustrated in FIG. 8 is shifted by one-fifth of the clock cycle from the proceeding clock. In this manner, clocks having equally shifted phases are available to generate the serial output from the parallel to the serial converter.

The enable signals EN0 through EN4 illustrated at the bottom of the timing diagram of FIG. 8, indicate when each of the selectors 601 through 605 drive the differential outputs DIFFN and DIFFP. The signal EN0 depends upon the multiphase clock signals C3 and C4. When the multiphase clock signal C3 is asserted, and the multiphase clock signal C4 is de-asserted, the signal EN0 will be asserted. This is illustrated at time TA as indicated in FIG. 8. Likewise, the signal EN1 is dependent upon multiphase clock signals C4 and C0, such that when multiphase clock C4 is asserted and multiphase clock C0 is de-asserted the EN1 signal will be active. In similar manners, the EN2 signal is dependent upon multiphase clocks C0 and C1, EN3 signal is dependent upon multiphase clocks C0 and C2, and enable signal EN4 is dependent upon multiphase clocks C2 and C3.

As illustrated in FIG. 8, the use of a multiphase clock, provides for approximately $1/5^{th}$ of the time cycle to be made available to each of the data values associated with enable signals. Therefore, by gating the signals the data signals D0 through D4 with enable signals EN0 through E4, it is possible to assert each of the data values onto the differential output for approximately $1/5^{th}$ of the cycle time. This procedure is repeated for the second five-bits of the 10-bit data word. By processing odd numbered bits of data (five in the embodiment illustrated) it is possible to use a simplified circuit using an odd number of multiphase clocks to convert a 10-bit digital video signal into a serial video signal having a low voltage swing. This is an advantage over the prior art, in that the prior art processes an even number of bits using a multiphase clock having an even number of clocks. Multiphase clocks having an even number of clocks require more complex design techniques as opposed to the Multiphase clock of the present invention which can be implemented using simple inverters.

The present invention has been described with respect to specific embodiments. It will be appreciated that variations of the specific embodiments can be made without departing from the scope of the invention. For example, transistors other than N-type transistors can be used to implement the selectors of FIG. 6. In addition, other selector circuits with additional or no gates can be utilized to implement the selectors.

We claim:

1. A method for transmitting graphics data, the method comprising the steps of:

receiving a data word having an even number of bits; and converting the data word to a serial stream using a multi-phased clock having an odd number of stages.

2. The method of claim 1, wherein the step of receiving includes receiving a ten-bit data word.

3. The method of claim 1, wherein the step of converting further includes converting the data word into a serial stream, wherein each data bit of the serial stream has a substantially similar time duration.

4. The method of claim 1, wherein the step of converting further includes converting the data word into a differential serial stream.

5. A data transmitter comprising:

a first latch having an even number of data inputs and an even number of data outputs;

a multi-phase clock generator having an odd number of clock outputs for providing an odd number of multi-phased clocks, and a parallel to serial converter coupled to receive data from the even number of data outputs, to receive the odd-number of multi-phased clocks, and having a serial output to provide serial data based upon the received data.

6. The transmitter of claim 5 further comprising:

a second latch to receive a first subset of data from the even number of data outputs of the first latch;

a third latch to receive a second subset of data from the even number of data outputs of the first latch, wherein the first and second subset of data include all of the even number of data outputs from the first latch; and the parallel to serial converter is coupled to receive only one of the first subset of data and the second subset of data at a time.

7. The data transmitter of claim 5, wherein the serial output of the parallel to serial converter includes a differential output.

8. The data transmitter of claim 5, wherein the parallel to serial converter includes an overdrive protection circuit.

9. A data transmitter comprising:

a first latch having an even number of data outputs;

a second latch having an odd number of data inputs coupled to a first portion of the data outputs of the first latch, and having an odd number of data outputs;

a multiplexor having a first set of inputs coupled to the data outputs of the second latch, a second set of inputs, and a plurality of outputs;

a third latch having a plurality of inputs coupled to the plurality of outputs of the multiplexor, and a plurality of outputs;

a parallel to serial converter having a plurality of data inputs coupled to the plurality of outputs of the third latch, a plurality of clock inputs, and an output;

a multi-phased clock generator having an odd number of clock stages having and odd number of clock outputs coupled to the plurality of clock inputs of the parallel to digital converter.

10. The data transmitter of claim 9 further comprising:

a fourth latch having an odd number of data inputs coupled to a second portion of the first latch data outputs, and having an odd number of data outputs coupled to the second set of inputs of the multiplexor.

11. The data transmitter of claim 9, wherein the serial output of the parallel to serial converter includes a differential output.

12. The data transmitter of claim 9, wherein the parallel to serial converter includes an overdrive protection circuit.

* * * * *